US008122877B2

(12) United States Patent
Baumann et al.

(10) Patent No.: US 8,122,877 B2
(45) Date of Patent: Feb. 28, 2012

(54) APPARATUS FOR FRONT-COOKING APPLICATIONS

(75) Inventors: Udo Baumann, Hamburg (DE); Deny Longo, Pordenone (IT); Michele Cadamuro, Treviso (IT)

(73) Assignee: Electrolux Professional SpA, Pordenone (IT)

( * ) Notice: Subject to any disclaimer, the term of this patent is extended or adjusted under 35 U.S.C. 154(b) by 782 days.

(21) Appl. No.: 11/892,791

(22) Filed: Aug. 27, 2007

(65) Prior Publication Data

US 2008/0087272 A1 Apr. 17, 2008

(30) Foreign Application Priority Data

Oct. 11, 2006 (IT) ..... PN2006A0077

(51) Int. Cl.
*F24C 15/20* (2006.01)

(52) U.S. Cl. ..... 126/299 C; 126/299 R; 126/299 D; 126/299 E; 454/63

(58) Field of Classification Search ..... 126/299 D, 126/299 R, 299 E, 299 C; 454/49, 67; 55/501, 55/516, 519, 529
See application file for complete search history.

(56) References Cited

U.S. PATENT DOCUMENTS

| | | | | |
|---|---|---|---|---|
| 1,001,383 | A * | 8/1911 | Geer et al. | 126/332 |
| 2,356,757 | A * | 8/1944 | Fleisher | 55/482 |
| 2,565,905 | A * | 8/1951 | Belau | 160/135 |
| 2,568,276 | A * | 9/1951 | Eggleston | 219/452.11 |
| 2,802,543 | A * | 8/1957 | Clark | 96/232 |
| 3,380,810 | A * | 4/1968 | Hamblin | 422/176 |
| 3,747,300 | A * | 7/1973 | Knudson | 96/58 |
| 3,954,427 | A * | 5/1976 | Jenn | 96/407 |
| 3,963,464 | A * | 6/1976 | Schinner | 96/241 |
| 4,411,254 | A * | 10/1983 | Field et al. | 126/300 |
| 4,440,555 | A * | 4/1984 | Chichester | 55/385.3 |
| 4,821,704 | A * | 4/1989 | Tucker et al. | 126/299 D |
| 4,826,517 | A * | 5/1989 | Norman | 55/418 |
| 5,000,160 | A * | 3/1991 | Dunlop et al. | 126/299 D |
| 5,433,763 | A * | 7/1995 | Shagott et al. | 55/323 |
| 5,494,497 | A * | 2/1996 | Lee | 55/480 |
| 5,967,136 | A * | 10/1999 | Gray et al. | 126/299 R |
| 6,354,283 | B1 * | 3/2002 | Hawkins et al. | 123/572 |
| 6,375,700 | B1 * | 4/2002 | Jaroszczyk et al. | 55/498 |
| 2008/0029081 | A1 * | 2/2008 | Gagas et al. | 126/299 D |
| 2008/0202491 | A1 * | 8/2008 | Eberhard | 126/299 D |

FOREIGN PATENT DOCUMENTS

DE 10114569 C1 * 4/2002

(Continued)

*Primary Examiner* — Steven B McAllister
*Assistant Examiner* — Desmond Peyton
(74) *Attorney, Agent, or Firm* — Wenderoth, Lind & Ponack, L.L.P.

(57) ABSTRACT

Food preparation apparatus including a top cooking surface, or cooktop, a front wall, a clear see-through wall located on the front side and extending above the top surface, a suction device adapted to take in fumes/odors or gases being generated at and released from the cooktop, the suction device including a forward inclined intake grille arranged between the cooktop and the vertical wall, the clear see-through wall being curved backwards, with the lower portion thereof extending almost vertically and then gradually curving backwards. A chamber collecting the gases being taken in is arranged below the grille and debouches into a vertical suction conduit, to which there is associated an appropriate suction fan, entering a prismatic filtering chamber provided with a filter in the form of a filtering partition arranged between two opposite sides of the chamber and lying orthogonally to the rear wall of the apparatus.

15 Claims, 6 Drawing Sheets

FOREIGN PATENT DOCUMENTS

| | | | | |
|---|---|---|---|---|
| JP | 63150530 | A | * | 6/1988 |
| JP | 63150532 | A | * | 6/1988 |
| WO | 2005/100863 | | | 10/2005 |
| WO | WO 2005100863 | A1 | * | 10/2005 |
| WO | 2006/024499 | | | 3/2006 |

* cited by examiner

APPARATUS FOR FRONT-COOKING APPLICATIONS

-BACKGROUND OF THE INVENTION

I. Field of the Invention

The present invention refers to an improved kind of food preparation apparatus of the type comprised of a free-standing work, i.e. cooking counter or bench that can be also installed in an isolated manner, in which it is separated from any other apparatus of the same or a different kind.

It is exactly for this reason that apparatus of this kind are frequently referred to as "cooking islands" in the art.

II. Description of the Related Art

These apparatus include appliances as the ones that are generally used in luncheonettes, lunch or snack bars, self-service restaurants, and the like, where food is cooked, but more often is prepared or undergoes final treatment, or is simply stored under hot-keeping conditions on the top working surface prior to its being distributed or served out to the final customers passing by in front of the same counter. This is also why terms like "front-cooking" or "bench-top units" are commonly used in the art when referring to such apparatus.

Exactly on the ground that these apparatus are generally not the ones that are used to actual or basic cooking purposes, they have to be easily and conveniently displaceable and, therefore, they shall not be connected to any stationary fume-extractor hood arrangement.

However, the kind of food preparation operations involved or usually taking place in such apparatus does not exclude the possibility for gases, odours and fumes to be produced at and be released from the worktop of these units.

Now, in view of removing and exhausting such fumes and gases, known in the art a solution involving the use of means to not only extract the gases and fumes from the zone lying immediately above the worktop, where the food is cooked, prepared, or simply kept stored under suitable conditions waiting to be served out, but also filter such gases and fumes to eventually exhaust them again into the same ambient from which they had been extracted.

Known from WO 2006/024499 is a kind of food preparation counter that comprises means adapted to extract gases being released by and rising from the worktop of the counter, filter such gases and exhaust them again into the same ambient. However, the front casing is in this case provided with an upper horizontal strip 47 projecting towards the rear zone, whose width is not sufficient to ensure that gases/fumes being released are intercepted to any adequate extent (cf. FIGS. 5, 8 and 9 accompanying the above-cited document). In addition, such gases/fumes are filtered by a filter that is located in the lower zone or portion of the apparatus, so that it proves quite awkward and inconvenient for the filter itself to be reached in view of replacing and/or cleaning it.

Known from WO 2005/100863 is a kind of food preparation counter that is provided with a suction hood extending on the front side to extract the fumes and gases issuing from the worktop thereof, as well as means to filter the gases/fumes and to exhaust them again into the same ambient from which they have been extracted. However, this front extraction hood 28 has such height and inclination as to make it practically impossible for a customer standing in front of the counter to pick up a dish therefrom.

Furthermore, the fume extraction zone is most obviously rather high relative to the worktop, so as to allow the operator to most conveniently and readily gain access to such worktop.

This circumstance, however, has the unfavourable effect of reducing the fume extraction efficiency to quite a significant extent.

Finally, even in this case the extracted fumes/gases are filtered through a filter that is arranged inside the body of the apparatus, which again makes it quite awkward and inconvenient for the filter to be reached in view of replacing or cleaning it.

Moreover, the ports through which the filtered gases are exhausted are located at the sides of the body of the apparatus, and this can be readily appreciated to represent a most likely source of inconvenience due to both greater noise being issued on the front side and the impracticableness of the same apparatus as far as the possibility for it to be approached from the sides.

SUMMARY OF THE INVENTION

It is therefore desirable, and is a main object of the present invention, to provide an improved apparatus for processing and preparing food, of the front-cooking or bench-top kind, in particular such apparatus intended for use in mass or commercial foodservice applications, which is provided with means and is capable of operating according to modes that are effective in ensuring that the above-described drawbacks and disadvantages are done away with or at least attenuated.

According to the present invention, these aims, along with further ones that will become apparent from the description given below, are reached in a kind of food preparation apparatus, in particular intended for mass and commercial foodservice applications, that incorporates the features and characteristics as recited and defined in the appended claims

BRIEF DESCRIPTION OF THE DRAWINGS

Further characteristics, features and advantages of the present invention will be more readily understood from the detailed description that is given below by way of non-limiting example with reference to the accompanying drawings, in which.

DETAILED DESCRIPTION OF THE INVENTION

Figure 1:
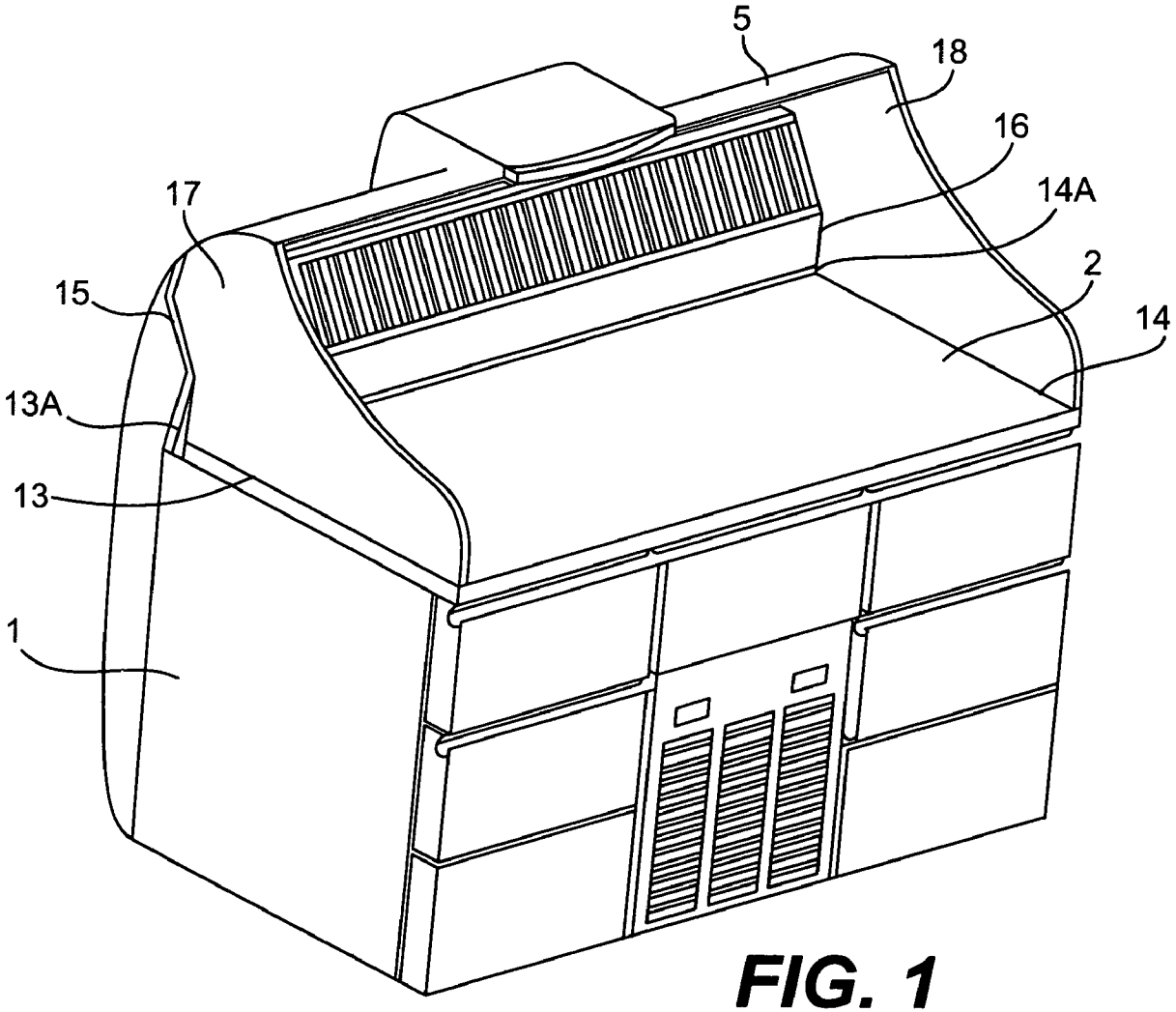
FIG. 1 is a perspective outer view of a food cooking or preparation apparatus of the "front-cooking" or "bench-top" type according to the present invention.
Figure 2:
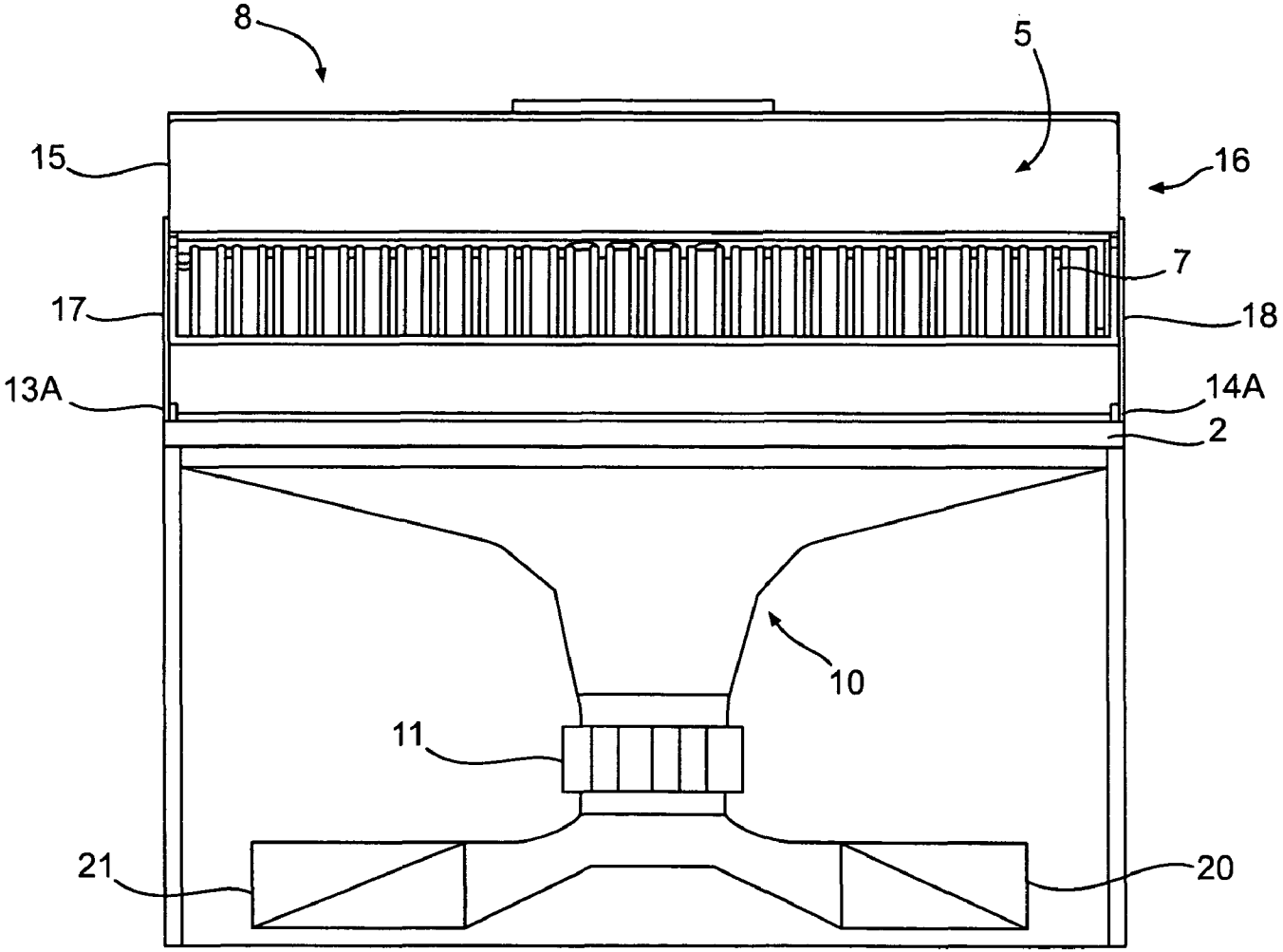
FIG. 2 is a front planar view of the apparatus shown in FIG. 1, as viewed by an operator thereof.

With reference to the above-cited Figures, a food processing or preparation apparatus according to the prior art comprises:

- an outer casing 1,
- a top surface such as a cooktop or, more generally, a worktop 2,
- a front wall 3,
- a rear wall 4,
- a second front wall 5 extending above said top surface 2,
- suction means adapted to take in, i.e. extract the gases or fumes that are generally generated at and released from said worktop 2, and comprising a suction mouth provided in the internal zone of said second upper front wall 5, filtering means adapted to filter said gases or fumes and exhaust them again into the ambient from which they had been extracted.

According to the present invention, the suction mouth 6 is not situated in a raised position at the height of the upper edge of said second front wall 5, but is rather positioned exactly in correspondence to the portion at which the worktop 2 intersects the same second vertical wall 5, and is substantially as large as the worktop itself. Preferably, it is closed on top by a grille 7, so as to prevent foreign matters of any kind from being able to be accidentally introduced in the same suction mouth and giving rise to a number of possible problems, such as for instance the possibility for them to cause the suction fan to run into a locked condition.

Figure 3:
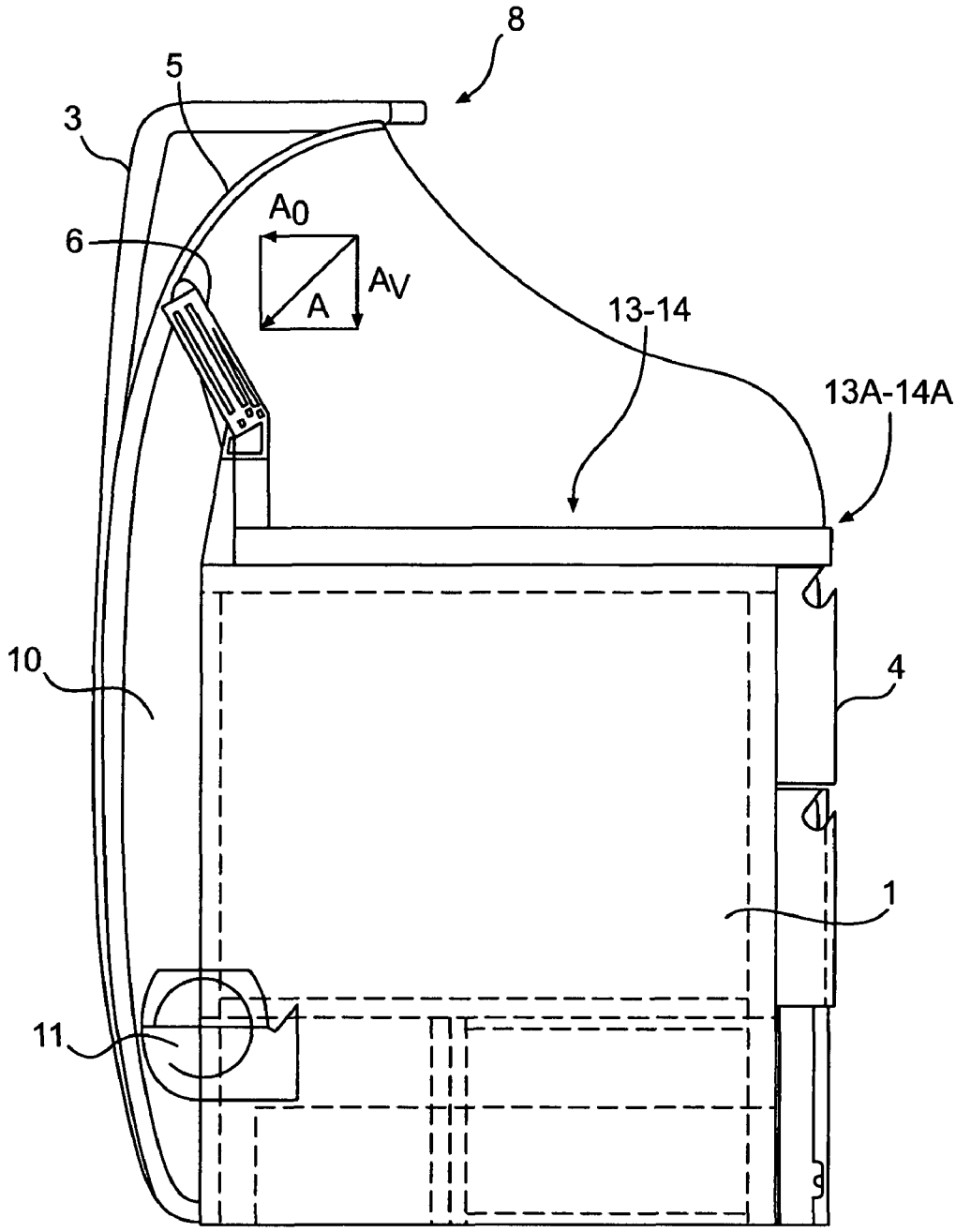
FIG. 3 is a side planar view of the apparatus shown in FIGS. 1 and 2.

Said second upper front wall 5 can therefore be made in the form of just a thin curved plate. With reference to FIGS. 1 and 3, in an advantageous manner this second upper front plate 5 starts extending upwards from the front wall 3 in an almost vertical direction; then it goes on by gradually curving towards the zone of the worktop 2 until it eventually becomes almost horizontal.

In this final configuration, it protrudes backwards with a quite remarkable overhang, so that its rearmost edge 8 comes to lie in a position located beyond the vertical of the centre-line extending across said casing 1.

It has in fact been found that such backward-oriented overhang, when combined with the suction effect on the horizontal plane ensured by the horizontal orientation of the final length of said wall 5, is effective in ensuring a very efficient, optimum performance in extracting the fumes and gases generated at and released from the worktop 2, including the fumes being released from the zone of the worktop that is not actually covered by the overhanging portion of said wall 5.

In addition, at least in the upper portion thereof, such second wall 5 is suitably made of a clear, i.e. see-through, material, so that a customer standing in front of the apparatus is capable of conveniently and unobstructedly viewing the food lying on said worktop 2 for a proper selection thereof, as well as for watching the manner in which the selected food is prepared.

Said grille 7 is furthermore advantageously inclined towards the worktop 2, i.e.—as clearly shown in FIG. 3—it features such an inclination as to make sure that the suction vector A of the gases being extracted by said grille has both a top-down vertical component $A_v$ and a horizontal component $A_o$ moving parallel to the direction that goes from the rear wall 4 to the front wall 3.

In view of further facilitating the conveyance of the gases towards said grille, and preventing any portion of said gases from being able to escape from or at the sides, between the side edges 13 and 14 of the worktop 2 and the side edges 15 and 16 of said second upper wall 5 there are advantageously provided two vertical wings 17, 18 that preferably rise up from the rear corners 13A and 14A of the respective said side edges 13 and 14.

Under the afore-cited mouth 6—and connected thereto—there is provided a vertical, sensibly central suction conduit 10, in which there is provided an appropriate suction fan 11.

Downstream from said fan, said conduit 10 extends downwards to debouch into two filtering chambers 20 and 21, which are provided and arranged symmetrically relative to said conduit 10, these two chambers being in general located near the bottom and at the sides on the rear of said outer casing.

Owing to these chambers 20, 21 being not only symmetrical, but also fully similar to each other, only one of them will be described hereinbelow, wherein it shall be readily appreciated that the considerations set forth in this connection obviously apply—in a corresponding manner—also to the other filtering chamber.

Figure 4:
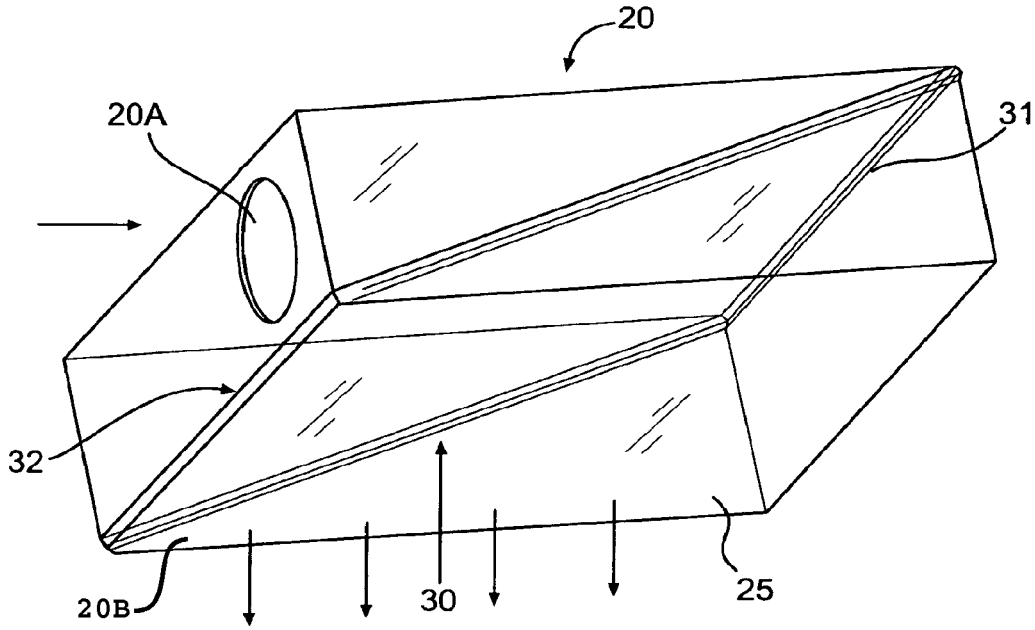
FIG. 4 is a see-through view of a component part of the apparatus shown in FIGS. 1, 2 and 3.

With reference to FIG. 4, the filtering chamber 20 is formed in the shape of a rectangular parallelepiped and is provided with an inflow port 20A, whereas the stream of filtered air is let out directly downwards, i.e. through the immaterial surface of the same base, whose perimeter is indicated by 20B.

Inside this filtering chamber 20 there is arranged a filter plate 30, of a kind as generally known as such in the art, that is adapted to intercept and filter out even the smallest solid residues and fume and fat particles contained in the gas passing through said filter plate. It is on the other hand a largely known and established fact that the larger the filtering surface area of a filter plate whatsoever, the more efficient will be the filtering effect of such filter plate and the smaller the pressure drop it implies in the flow of gas passing therethrough.

Figure 5:
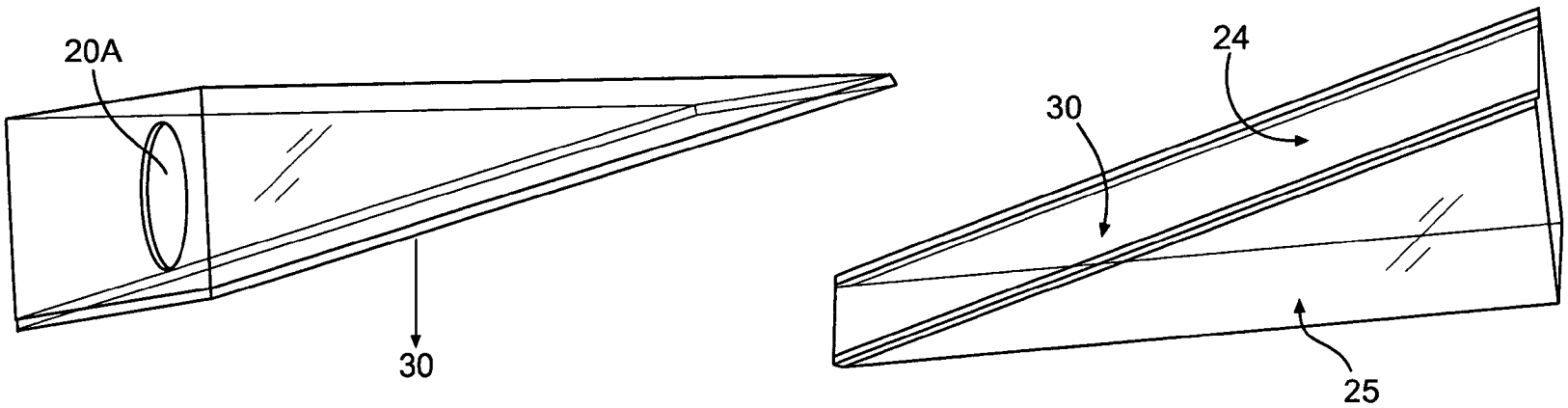
FIG. 5 is an exploded view of the component part shown in FIG. 4.
Figure 6:
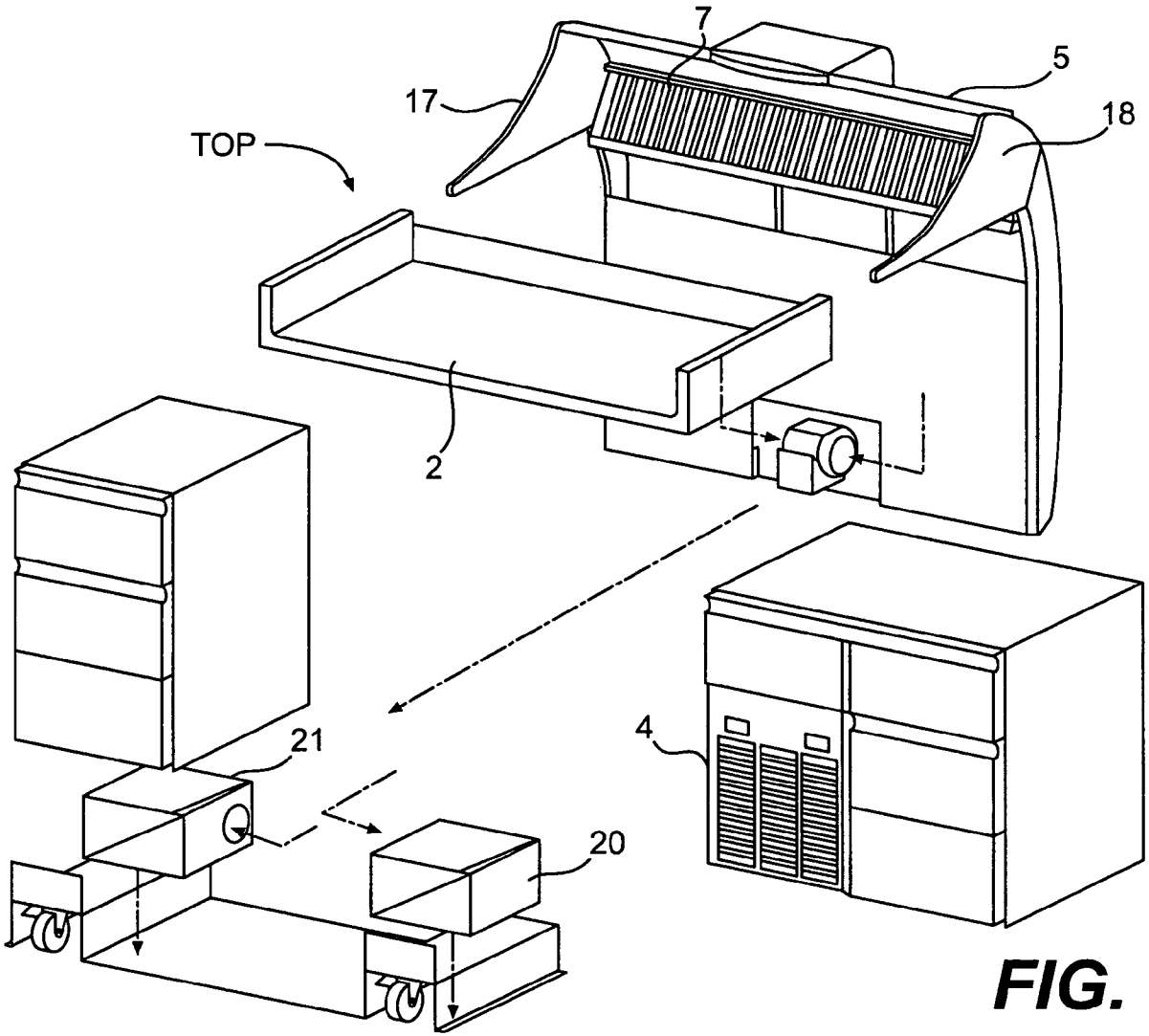
FIG. 6 is a schematic exploded view of the apparatus shown in FIG. 1.

Accordingly, in view of taking as full as possible an advantage of the planar surface area available in the filtering chamber 20, the above-cited filter plate 30 is arranged between two parallel and diagonally opposite sides 31 and 32 of said chamber 20, so that the filtering chamber 20 itself is practically subdivided into two prismatic volumes 23 and 24, as this is schematically illustrated in FIG. 5.

In addition, in view of ensuring that such filtering plates 30 are capable of being readily removed and replaced from the outside, in particular by the same operator in attendance of the apparatus, these filter plates are arranged so as to lie orthogonally to the plane of the rear wall 4 and capable of being accessed, i.e. reached from such wall.

Therefore, when the filtering chamber 20 is made and provided so that:

the backwards facing wall 25 thereof can be opened or removed from the outside, and the respective filter plate 30 is arranged orthogonally to said wall and is in turn easily removable, and replaceable, by simply letting it slide along said two support sides 31 and 32, the extremely advantageous result is obtained of combining the most desirable effects of a very high filtering efficiency and a very low loss of flow pressure with an improved replaceability and serviceability of the filters themselves in a single and same apparatus.

Said filter plate 30 can of course be oriented outwards and—at the same time—upwards, as illustrated in FIG. 4, or also in such manner as to cause the stream of filtered air to be exhausted towards the wall that faces backwards, towards the operator. In this case, the filter plate 30 may be positioned on a vertical plane and be delimited, along two opposite edges thereof, by two vertical, diagonally opposed sides of said chamber 20 (not shown in the Figures).

Such different arrangement, however, does by no means affect the need for the respective inflow port 20A to direct the flow into a definite one, e.g. the one indicated at 23, of said prismatic volumes 23 and 24, and the related outflow port 20B to open up into the other one, e.g. the one indicated at 24, of said prismatic volumes and, obviously, towards said rear wall 4.

Fully apparent from the above description and, in particular, the illustration appearing in FIG. 1 is therefore the ability of the inventive apparatus to achieve optimum results in terms of efficient air circulation and operating quietness, owing to the fact that the flow of air is re-circulated along an almost closed-loop flow-path, which is in particular curved in a continuous, progressive and by no means abrupt manner, wherein elbow-shaped sections, in which through-flowing gases may give rise to hissing or roaring sounds, are above all reduced to a minimum.

The invention claimed is:

1. A free-standing apparatus for cooking or preparing food, for mass or commercial foodservice applications, said free-standing apparatus comprising:

an outer casing, a top surface having a cooktop, a front wall, a rear wall, a second front upper wall extending above said top surface, a suction device configured to extract gases or fumes that are generated at and released from said cooktop, a filtering device configured to filter said gases or fumes being extracted, wherein said suction device comprises a suction mouth disposed between said cooktop and said second front upper wall and extending substantially over the entire width of said outer casing;

wherein said suction device includes a suction conduit that is disposed under said mouth, oriented downwards, and arranged centrally and vertically in said outer casing, wherein a suction fan is associated with said suction conduit, wherein a lower portion of said conduit is connected via an inflow port to at least a filtering chamber that includes a related exhaust section, wherein said filtering chamber has a prism shape having a quadrangular cross-section, and is provided with a filter plate arranged between two diagonally opposed, non contiguous sides of said filtering chamber, wherein said filter plate is arranged on a plane that is substantially orthogonal to said rear wall, and subdivides said filtering chamber into first and second contiguous prismatic volumes, each of said first and second contiguous prismatic volumes having a triangular cross-section and wherein the suction fan exhausts air in a rearward direction, said air enters into said air filtering device in a direction substantially horizontally orthogonal to said rearward direction and said exhausts said filtering device downwardly.

2. An apparatus according to claim 1, wherein said second front wall has a curved conformation, such that said second front wall extends substantially vertically at a lower portion thereof and gradually curves rearwards until said second front upper wall becomes substantially horizontal.

3. An apparatus according to claim 1, wherein a grille is disposed on top of said suction mouth.

4. An apparatus according to claim 3, wherein said grille is inclined forwards and upwards so as to be oriented in a direction from said cooktop to said second front upper wall.

5. An apparatus according to claim 1, further comprising first and second side wings arranged so as to extend vertically between first and second upper side edges of said cooktop, respectively, and first and second curved side edges or portions of said second front upper wall, respectively.

6. An apparatus according to claim 5, wherein said first and second side edges have first and second rear corners, respectively, and said first and second wings rise up from said first and second rear corners, respectively.

7. An apparatus according to claim 1, wherein said second front upper wall is at least partially transparent.

8. An apparatus according to claim 1, wherein said inflow port opens into said first prismatic volume, and said exhaust aperture opens from said second prismatic volume.

9. An apparatus according to claim 8, wherein said exhaust aperture opens downwards.

10. An apparatus according to claim 1, wherein said filter plate is arranged on a plane that is and inclined relative to said top surface, and said inflow port opens into said first prismatic volume, and said exhaust aperture opens out of the second prismatic volume towards said rear wall.

11. An apparatus according to claim 2, wherein a grille is disposed on top of said suction mouth.

12. An apparatus according to claim 2, wherein said second front upper wall is at least partially transparent.

13. An apparatus according to claim 3, wherein said second front upper wall is at least partially transparent.

14. An apparatus according to claim 4, wherein said second front upper wall is at least partially transparent.

15. An apparatus according to claim 1, wherein said rear is capable of being opened, so as to enable removal of said filter plate.

* * * * *